US008382108B2

(12) United States Patent
Gao et al.

(10) Patent No.: US 8,382,108 B2
(45) Date of Patent: Feb. 26, 2013

(54) RECORDING MEDIUM OVERTURNING MECHANISM AND RECORDING MEDIUM PROCESSING APPARATUS USING THE SAME

(75) Inventors: Ming Gao, Weihai (CN); Zhenxing Zhao, Weihai (CN); Zhigang Xu, Weihai (CN); Qiangzi Cong, Weihai (CN); Tianxin Jiang, Weihai (CN)

(73) Assignee: Shangdong New Beiyang Information Technology Co., Ltd., Weihai (CN)

( * ) Notice: Subject to any disclaimer, the term of this patent is extended or adjusted under 35 U.S.C. 154(b) by 0 days.

(21) Appl. No.: 13/376,031

(22) PCT Filed: Jul. 23, 2010

(86) PCT No.: PCT/CN2010/075428

§ 371 (c)(1), (2), (4) Date: Dec. 2, 2011

(87) PCT Pub. No.: WO2011/012059

PCT Pub. Date: Feb. 3, 2011

(65) Prior Publication Data

US 2012/0119438 A1 May 17, 2012

(30) Foreign Application Priority Data

Jul. 31, 2009 (CN) ..... 2009 1 0162517

(51) Int. Cl.
*B65H 29/00* (2006.01)
*B65H 39/10* (2006.01)

(52) U.S. Cl. ..... 271/291; 271/186

(58) Field of Classification Search ..... 271/186, 271/291
See application file for complete search history.

(56) References Cited

U.S. PATENT DOCUMENTS 4,078,789 A * 3/1978 Kittredge et al. ..... 271/65
4,699,367 A * 10/1987 Russel ..... 271/65
5,106,075 A * 4/1992 Wafford et al. ..... 271/186
(Continued)

FOREIGN PATENT DOCUMENTS

CN 1331650 1/2002
(Continued)

OTHER PUBLICATIONS

International Search Report for PCT/CN2010/075428, dated Feb. 3, 2011 (6 pgs.).

*Primary Examiner* — David H Bollinger
(74) *Attorney, Agent, or Firm* — Shumaker & Sieffert, P.A.

(57) ABSTRACT

The present invention provides a recording medium overturning mechanism, comprising: a bracket (100); an entry (50) and an exit (60), arranged in the bracket (100); a first channel (10), communicating the entry (50) with the exit (60) to convey a recording medium which does not need to be overturned; a second channel (20), communicating with the entry (50) to convey a recording medium which needs to be overturned; a third channel (30), communicating with the exit (60) and the second channel (20) to convey the overturned recording medium, wherein the first channel (10), the second channel (20) and the third channel (30) are basically arranged in an inverted triangle and joined with each other; a channel switching mechanism (40), arranged on the bracket (100) and located at a joining area between the first channel (10) and the second channel (20); and an overturning roller (70), arranged on the bracket (100) and located at a joining area between the second channel (20) and the third channel (30), the overturning roller (70) is driven by a motor (M), and the overturning roller (70) firstly rotates in a first direction to convey the recording medium away from the second channel (20), and then rotates in a direction opposite to the first direction to send the recording medium into the third channel (30). The present invention is simple in structure, small in volume and low in cost.

10 Claims, 6 Drawing Sheets

U.S. PATENT DOCUMENTS

| | | | | | |
|---|---|---|---|---|---|
| 5,179,272 | A * | 1/1993 | Ono et al. | 235/476 |
| 5,303,017 | A * | 4/1994 | Smith | 399/403 |
| 5,887,868 | A * | 3/1999 | Lambert et al. | 271/186 |
| 6,129,349 | A * | 10/2000 | Olbrich et al. | 271/186 |
| 6,186,496 | B1 * | 2/2001 | Marasco et al. | 271/186 |
| 8,172,228 | B2 * | 5/2012 | Huala et al. | 271/303 |

FOREIGN PATENT DOCUMENTS

| | | |
|---|---|---|
| CN | 1488563 | 4/2004 |
| CN | 101081668 | 12/2007 |
| CN | 201485087 | 5/2010 |
| JP | 6271166 | 9/1994 |

* cited by examiner

RECORDING MEDIUM OVERTURNING MECHANISM AND RECORDING MEDIUM PROCESSING APPARATUS USING THE SAME

FIELD OF THE INVENTION

The present invention relates to a recording medium overturning mechanism and a recording medium processing apparatus using the same.

BACKGROUND OF THE INVENTION

As everyone knows, a recording medium comprises two surfaces. In one situation, the two surfaces are identical, without any differences; and in the other situation, the two surfaces are not identical, such as a thermal sensitive paper, one surface of which has a thermal sensitive coating while the other surface of which has no coating, and a magnetic ticket, one surface of which has a magnetic stripe while the other surface of which has no magnetic stripe. To describe conveniently, a recording medium with two surfaces which are not identical is named as a recording medium with front and back surfaces, wherein the front surface is called as a surface to be processed while the back surface is called as a non-processing surface.

For a traditional recording medium processing apparatus such as a printing apparatus and a magnetic head apparatus, a printing head or a magnetic head is located at one side of a channel, therefore it is necessary for the front surface (i.e., the printing surface or the magnetic surface) of the recording medium to correspond with the printing head or the magnetic head. However, operation errors made by the operator often result in a non-correspondence between the front surface of the recording medium and the printing head or the magnetic head, and the printing of the recording medium or the processing of magnetic reading/writing cannot be accomplished smoothly. To solve this problem, a recording medium overturning mechanism is provided in a Japanese Patent Publication No. 06-271166, as shown in FIGS. 1*a*, 1*b* and 1*c*. The recording medium overturning mechanism comprises a first channel 10, a second channel 20, a rotating roller 80, a switching member 81 and an electromagnet 82. The switching member 81 is located between the first channel 10 and the second channel 20 for switching the travelling direction of the recording medium. The electromagnet 82 is provided to control whether the second channel 20 is able to convey a medium or not. FIG. 1*a* is a conveying path of the recording medium when it is not overturned. The switching member 81 rotates in the direction D to make the recording medium 2 enter the first channel 10 via an entry A and exit through an exit B. FIGS. 1*b* and 1*c* show a conveying path of the recording medium when it is overturned. The specific method comprises: step a), in which the switching member 81 rotates in the direction F to make the recording medium 2 enter the second channel 20 via the entry A, the electromagnet 82 drives a driving roller 77 to cooperate with a driven roller 75 of the second channel 20, and the medium is driven to enter the second channel 20; and step b), in which the electromagnet 82 drives the driving roller 77 to separate from the driven roller 75 of the second channel 20, meanwhile a floating wheel 74 is driven to cooperate with the rotating roller 80, and the medium is conveyed into the second channel 20 in a direction opposite to the direction of step a) and exits through the exit B.

At least the following problems are present in the prior art: the existing recording medium overturning mechanism comprises a first channel, a second channel, a switching member, an electromagnet, a rotating roller and other parts, the first channel and the second channel further comprise multiple belts and several rotating rollers, thus making the structure complex; meanwhile, when the recording medium is overturned, the switching member, the driving roller and the floating wheel of the second channel need to be switched, respectively, thus making the control intricate.

SUMMARY OF THE INVENTION

The present invention aims to provide a recording medium overturning mechanism to solve the problems of the structure being complex and the control being intricate and the like in the existing recording medium overturning mechanism.

The present invention provides a recording medium overturning mechanism for conveying a recording medium with a front surface and a back surface, comprising: a bracket; an entry and an exit, arranged in the bracket; a first channel, communicating the entry with the exit to convey a recording medium which does not need to be overturned; a second channel, communicating with the entry to convey a recording medium which needs to be overturned; a third channel, communicating with the exit and the second channel to convey the overturned recording medium; wherein the first channel, the second channel and the third channel are basically arranged in an inverted triangle and joined with each other; a channel switching mechanism, arranged on the bracket and located at a joining area between the first channel and the second channel, for distributing the recording medium which does not need to be overturned into the first channel or the recording medium which needs to be overturned into the second channel; and an overturning roller, arranged on the bracket and located at a joining area between the second channel and the third channel, the overturning roller, driven by a motor, firstly rotates in a first direction to convey the recording medium away from the second channel, and then rotates in a direction opposite to the first direction to send the recording medium into the third channel.

Preferably, the channel switching mechanism is hinged on the bracket, and the channel switching mechanism comprises a first surface used to form the first channel and a second surface used to form the second channel.

Preferably, the channel switching mechanism is a rotating plate, for switching the first channel to communicate with the entry while closing the second channel; or for switching the second channel to communicate with the entry while closing the first channel.

Preferably, the recording medium overturning mechanism further comprises: an elastic apparatus, arranged on the bracket; and a first rotary plate, located at a joining area between the second channel and the third channel, wherein the first rotary plate is hinged with the bracket and rotationally connected with the elastic apparatus, for closing an exit end of the second channel under the elastic force of the elastic apparatus.

Preferably, the recording medium overturning mechanism further comprises: a second rotary plate, located at a joining area between the third channel and the first channel, and hinged with the bracket, for closing an exit end of the third channel under the gravity.

Preferably, the recording medium overturning mechanism further comprises: an electromagnet, arranged on the bracket, wherein the electromagnet is connected with the channel switching mechanism for controlling the channel switching mechanism.

Preferably, a conveying roller for conveying the recording medium is provided at the entry and the exit, respectively.

The present invention further provides a recording medium processing apparatus, comprising the recording medium overturning mechanism described in any one of the preceding technical solutions, a ticket identifying apparatus for judging the direction of the front or back surface of the recording medium and a processor for processing the recording medium, wherein the ticket identifying apparatus is provided at the entry of the recording medium overturning mechanism, and the processor is provided at the exit of the recording medium overturning mechanism.

Preferably, the ticket identifying apparatus is a magnetic head identifying apparatus or an optical module identifying apparatus.

Preferably, the processor is a printing apparatus or a magnetic head apparatus.

Since the first channel, the second channel and the third channel are basically arranged in an inverted triangle and joined with each other, when overturning a recording medium, firstly the channel switching mechanism distributes the recording medium with its back surface upwards into the second channel, next, the overturning roller firstly rotates in a first direction to convey the recording medium away from the second channel, and then rotates in a direction opposite to the first direction to send the recording medium into the third channel, and the recording medium is conveyed along the third channel to the exit, whereby achieving the overturning of the front and back surfaces of the recording medium. Thus, the overturning of a recording medium is attained in the present invention only by switching the channel switching mechanism and controlling the rotation directions of the overturning roller, without switching the position states and rotation directions of multiple mechanisms as in the prior art. This not only simplifies the structure and controlling method of the recording medium overturning mechanism but also reduces the quantity of the power sets and the cost of the apparatus.

BRIEF DESCRIPTION OF THE DRAWINGS

The drawings, constituting a part of the present specification and used for further understanding the present invention, illustrate the preferred embodiments of the present invention, and are used together with the specification for describing the principle of the present invention. In the drawings.

DETAILED DESCRIPTION OF THE EMBODIMENTS

Figure 1A:
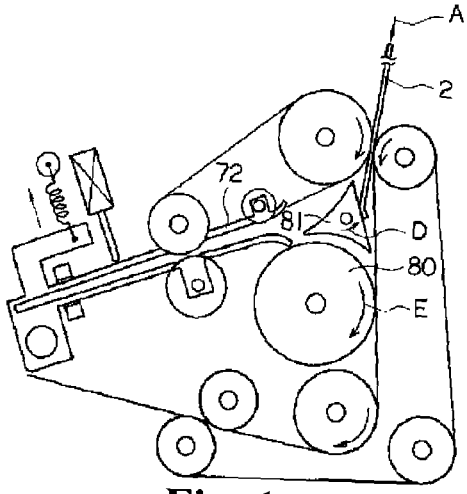
FIG. 1*a* schematically illustrates the structure of a recording medium overturning mechanism in the prior art, wherein a conveying path of the recording medium when it is not overturned is shown.
Figure 1B:
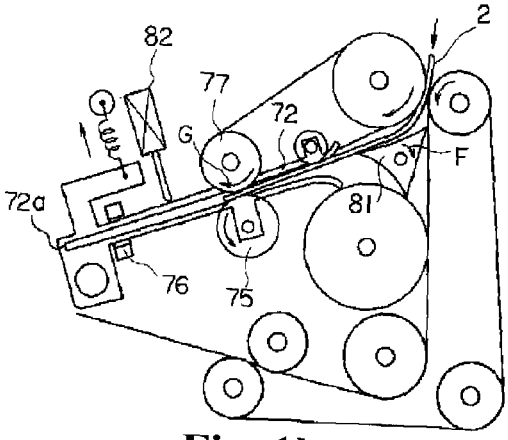
FIG. 1*b* schematically illustrates the structure of the recording medium overturning mechanism in the prior art, wherein a first conveying path of the recording medium when it is overturned is shown.
Figure 1C:
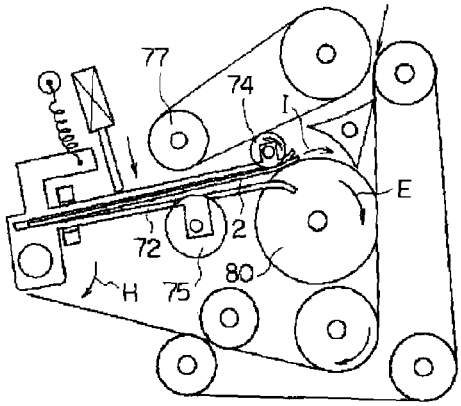
FIG. 1*c* schematically illustrates the structure of the recording medium overturning mechanism in the prior art, wherein a second conveying path of the recording medium when it is overturned is shown.

The present invention will be described in detail with reference to the drawings and in combination with the embodiments.

FIG. 2 to FIG. 5 schematically illustrates the structure of a recording medium overturning mechanism according to an embodiment of the present invention. As shown in the figures, the recording medium overturning mechanism according to the embodiment of the present invention is used to convey a recording medium with a front surface and a back surface, and the recording medium overturning mechanism comprises: a bracket 100; an entry 50 and an exit 60, arranged in the bracket 100; a first channel 10, communicating the entry 50 with the exit 60 to convey the recording medium with its front surface upwards; a second channel 20, communicating with the entry 50 to convey the recording medium with its back surface upwards; a third channel 30, communicating with the exit 60 and the second channel 20 to convey the recording medium with its front surface upwards, wherein the first channel 10, the second channel 20 and the third channel 30 are basically arranged in an inverted triangle and joined with each other; a channel switching mechanism 40, arranged on the bracket 100 and located at a joining area between the first channel 10 and the second channel 20 to distribute the recording medium with its front surface upwards into the first channel 10 or the recording medium with its back surface upwards into the second channel 20; and an overturning roller 70, arranged on the bracket 100 and located at a joining area between the second channel 20 and the third channel 30, wherein the overturning roller 70, driven by a motor, firstly rotates in a first direction to convey the recording medium away from the second channel, and then rotates in a direction opposite to the first direction to send the recording medium into the third channel.

Figure 5:
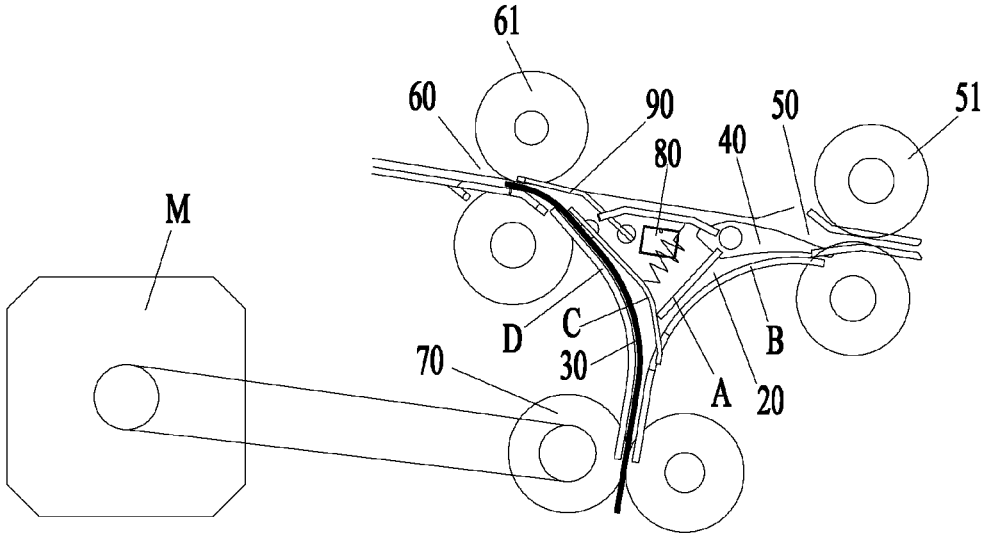
FIG. 5 schematically illustrates the structure of the recording medium overturning mechanism according to the embodiment of the present invention, wherein the recording medium is located at a third channel.

The recording medium overturning mechanism according to the embodiment of the present invention is used to convey a recording medium with a front surface and a back surface, such as a thermal sensitive paper, a magnetic ticket paper and the like. The recording medium overturning mechanism comprises the bracket 100, as shown in FIG. 5, for example, the bracket can be a casing, providing support and fixation for other parts in the recording medium overturning mechanism. Various tickets can be input into the entry 50 and output from the exit 60. The first channel 10 can be a horizontal straight channel or an inclined channel. The first channel 10 is provided for conveying the recording medium in normal situation, for example, a ticket with its front surface upwards. The recording medium with its back surface upwards is conveyed by the second channel 20 to the overturning roller and then overturned, and the recording medium with its front surface upwards is output from the third channel 30.

Figure 2:
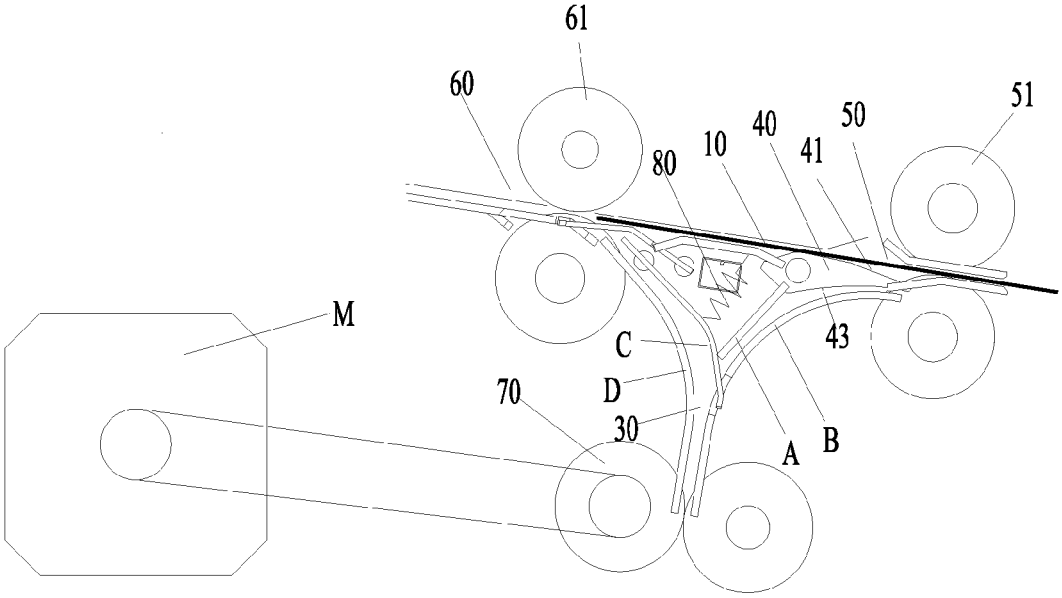
FIG. 2 schematically illustrates the structure of a recording medium overturning mechanism according to an embodiment of the present invention, wherein the recording medium is located at a first channel.
Figure 3:
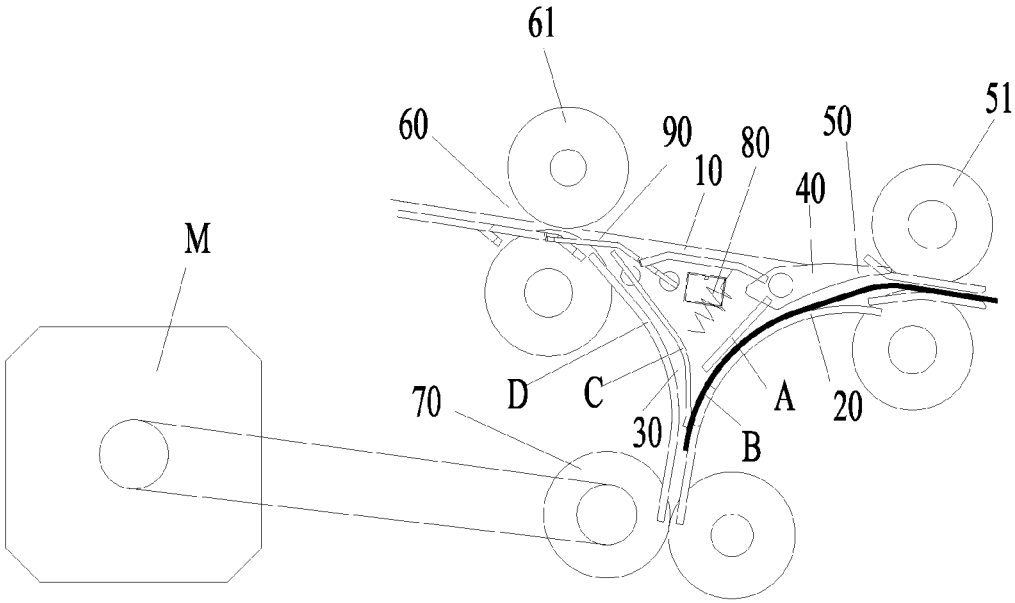
FIG. 3 schematically illustrates the structure of the recording medium overturning mechanism according to the embodiment of the present invention, wherein the recording medium is located at a second channel.
Figure 4:
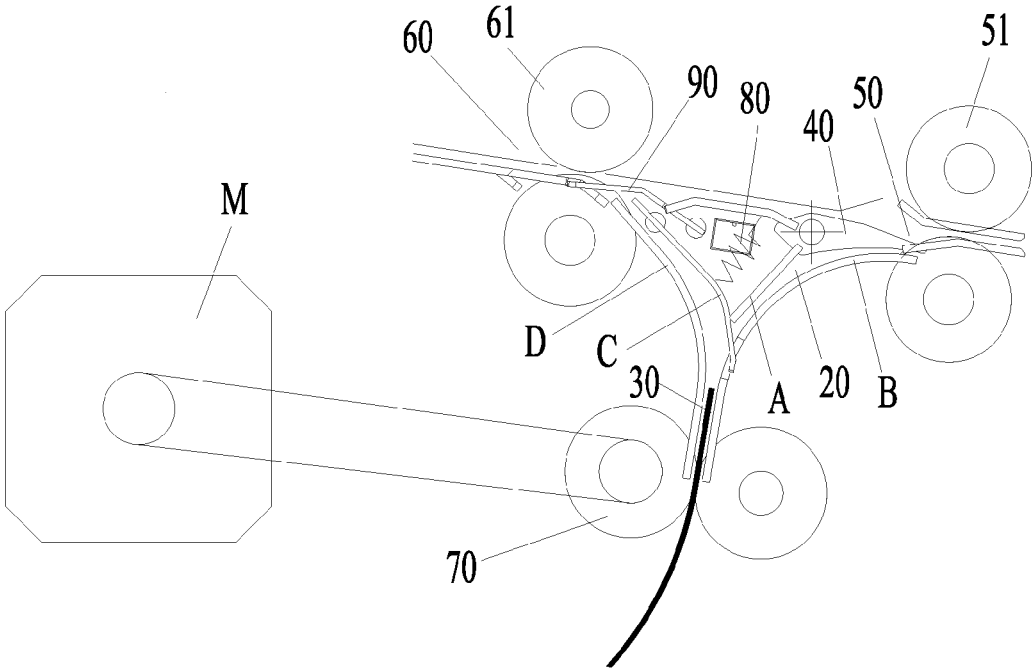
FIG. 4 schematically illustrates the structure of the recording medium overturning mechanism according to the embodiment of the present invention, wherein the recording medium is located at an overturning roller.

As shown in FIG. 2, the first channel 10, the second channel 20 and the third channel 30 are basically arranged in an inverted triangle, wherein the first channel 10 is at the top side of the inverted triangle. Of course, the first channel 10 is not limited to a horizontal arrangement and can be tilted at an angle, the second channel 20 and the third channel 30 can be straight channels or bended channels with a certain curvature, and the second channel 20 and the third channel 30 can be joined to form a shape of inverted "A".

Since the first channel, the second channel and the third channel are basically arranged in an inverted triangle and joined with each other, when overturning a recording medium, firstly the channel switching mechanism distributes the recording medium with its back surface upwards into the second channel, next, the overturning roller firstly rotates in a first direction to convey the recording medium away from the second channel, and then rotates in a direction opposite to the first direction to send the recording medium into the third channel, and the recording medium is conveyed via the third channel to the exit, whereby achieving the overturning of the front and back surfaces of the recording medium. Thus, the overturning of a recording medium is attained in the present invention only by switching the channel switching mechanism and controlling the rotation directions of the overturning roller, without switching the position states and rotation directions of multiple mechanisms as in the prior art. This not only simplifies the structure and controlling method of the recording medium overturning mechanism but also reduces the quantity of the power sets and the cost of the apparatus.

Typically the channel switching mechanism 40 is controlled to distribute the recording medium with its front surface upwards into the first channel 10 or distribute the recording medium with its back surface upwards into the second channel 20. Preferably, the channel switching mechanism 40 is controlled by an electromagnet to switch the channels. The electromagnet is arranged on the bracket 100 and connected with the channel switching mechanism 40 for controlling the channel switching mechanism 40. Of course, other apparatus can be adopted to control the channel switching mechanism 40.

Preferably, the channel switching mechanism 40 is hinged on the bracket 100. The channel switching mechanism 40 comprises a first surface 41 and a second surface 43 which is used to form the second channel 20. Of course, the first surface 41 and the second surface 43 can be flat surfaces or curved surfaces. In this way, the switching of the channels can be attained in an easy and convenient manner, reducing the number of the driving devices as well as the cost.

Preferably, the channel switching mechanism 40 is a rotating plate, for switching the first channel 10 to communicate with the entry 50 while closing the second channel 20; or for switching the second channel 20 to communicate with the entry 50 while closing the first channel 10. Since the channel switching mechanism 40 can be rotated, the first surface 41 is used for forming the first channel 10 meanwhile it is overlapped or inserted in the inner surface of the second channel 20 to close the second channel 20. When the channel switching mechanism 40 rotates upwardly in a counterclockwise direction, the second surface 43 closes the first channel 10 while opening the second channel 20. With such arrangement, the structure is simple and the cost is low, and the recording medium can be prevented from entering individual channels simultaneously, thus improving the safety and reducing the failure rate.

The second channel 20 for example can comprise a channel plate A and a channel plate B; and the third channel 30 for example can comprise a channel plate D, a channel plate E and a first rotary plate C. It is to be noted that the quantity of the channel plates is related to the specific structure of the channels, and not limited to the above-mentioned settings. Preferably, the recording medium overturning mechanism further comprises: an elastic apparatus 80 arranged on the bracket 100 and the first rotary plate C located at a joining area between the second channel 20 and the third channel 30. The first rotary plate C is hinged with the bracket 100 and rotationally connected with the elastic apparatus 80, for example connecting with a spring, to achieve a one-way communication from the second channel 20 to the third channel 30. As shown in FIG. 2, when the recording medium is not in the second channel 20, the first rotary plate C overlaps or inserts in the channel plate B of the second channel under the elastic force of the elastic apparatus 80, closing the second channel 20. When the recording medium is passing through the second channel 20, since the recording medium has a certain speed and mass, the impulsive force of the recording medium overcomes the elastic force of the elastic apparatus 80, the lower end of the first rotary plate C is open and the recording medium enters the overturning roller. At this point, the recording medium separates from the second channel 20, the first rotary plate C returns to the state where it overlaps or inserts in the channel plate B of the second channel under the elastic force of the elastic apparatus 80, the second channel 20 is closed again, whereby the recording medium will not come back to the second channel 20, that is to say, after the forward and backward rotations of the overturning roller, the recording medium can be sent only into the third channel. The overturning roller 70 is driven by a motor M, which can rotate in a forward and backward direction, the overturning roller firstly rotates in a first direction to convey the recording medium away from the second channel, and then rotates in a direction opposite to the first direction to send the recording medium into the third channel.

Preferably, the recording medium overturning mechanism further comprises: a second rotary plate 90, located at a joining area between the third channel 30 and the first channel 10, and hinged with the bracket 100, for achieving a one-way communication from the third channel 30 to the first channel 10. The second rotary plate 90 can be overlapped or inserted in the channel plate E under its self-weight by designing the length of the second rotary plate 90 and the position where it is hinged with the bracket 100. After the recording medium comes out from the overturning roller, since the recording medium has a certain speed, it will overcome the gravity of the second rotary plate 90 and impulse the second rotary plate 90 to open such that the recording medium reaches the exit 60. In this way, it can prevent the recording medium from reversely entering the third channel 30 from the first channel 10, thus preventing the accidental ticket blocking.

Preferably, a conveying roller 51 is provided at the entry 50, and a conveying roller 61 is provided at the exit 60 so as to be convenient for input and output of the recording medium.

It can be seen from the above-mentioned description, the following technical effects are attained from the above-mentioned embodiments of the present invention.

In the present invention, the overturning of the recording medium is attained only by switching the channel switching mechanism and controlling the rotation direction of the overturning roller, without switching the position states and rotation directions of multiple mechanisms as in the prior art. This not only simplifies the structure and controlling method of the recording medium overturning mechanism, but also reduces the quantity of the power sets and the cost of the apparatus.

Figure 6:
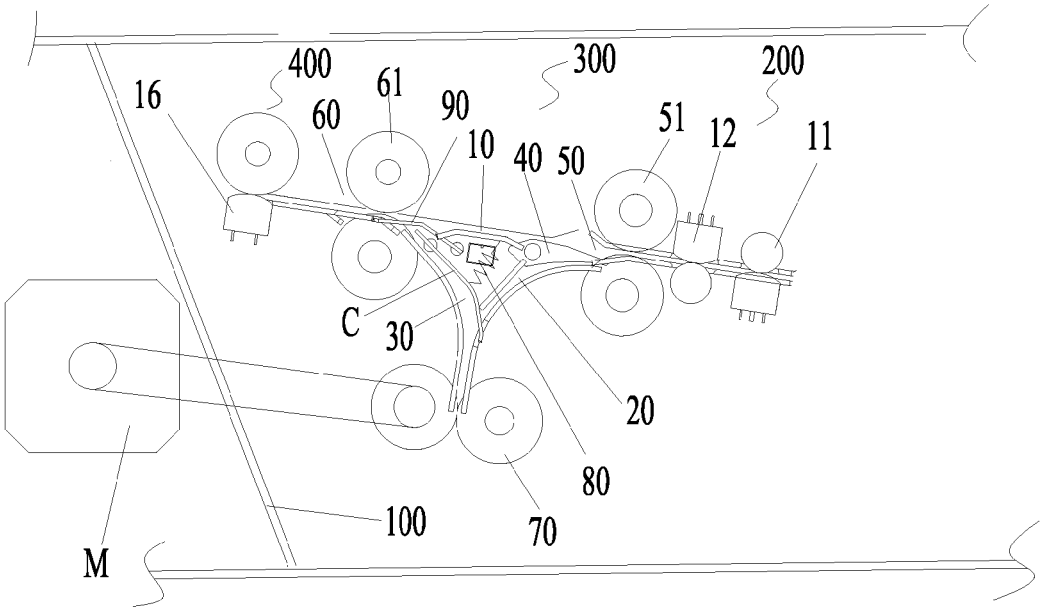
FIG. 6 schematically illustrates a recording medium processing apparatus according to an embodiment of the present invention.

The specific embodiment of the present invention further provides a recording medium processing apparatus having an overturning mechanism, as shown in FIG. 6. The recording medium processing apparatus comprises a ticket identifying apparatus 200, a recording medium overturning mechanism 300 described in any one of the preceding technical solutions and a processor 400. The ticket identifying apparatus 200 is provided at the side of the entry 50 of the recording medium overturning mechanism 300, and the processor 400 is provided at the side of the exit 60 of the recording medium overturning mechanism 300.

The ticket identifying apparatus 200 is used for judging whether the recording medium needs to be overturned or not, and the recording medium overturning mechanism 300 conduct corresponding operations to the recording medium according to the judging results of the ticket identifying apparatus 200. The processor 400 is used for processing the recording medium and can be a printing apparatus or a magnetic head apparatus for reading or writing magnetic data in a magnetic stripe of the recording medium. In the present embodiment, the processor 400 is a magnetic head apparatus 16. After the ticket paper passes through the recording medium overturning mechanism 300, the front surface (namely, the surface to be processed) of the ticket corresponds to the processing apparatus (such as a printing head of a printing apparatus and a magnetic head of a magnetic reading or writing apparatus).

The operation procedure of the recording medium processing apparatus is described in detail in the following.

The ticket identifying apparatus 200 judges whether the location of the front surface of the recording medium corresponds to the processing apparatus by identifying the features on the front surface of the recording medium, whereby determining whether the recording medium needs to be overturned or not. When the front surface of the recording medium corresponds to the processing apparatus, the recording medium does not need to be overturned; and when the front surface of the recording medium does not correspond to the processing apparatus, the recording medium needs to be overturned.

Since different recording media have different features on their front surfaces, the ticket identifying apparatus are different. When the recording medium has a magnetic stripe on one surface, the ticket identifying apparatus 200 can be a magnetic head identifying apparatus, for example, on both sides of the recording medium conveying channel are respectively provided magnetic heads 11 and 12 opposing to each other. Both of the magnetic heads are used to read information on the recording medium simultaneously, thus determining the location of the magnetic stripe. When the recording medium has remarks on one surface, the ticket identifying apparatus 200 can be an optical module identifying apparatus (not shown in the Figures), for example, CCD, CIS or a photoelectric sensor and the like. By providing optical modules opposing to each other on both sides of the recording medium channel respectively and using both of the optical modules to read remarks information on the recording medium simultaneously, the location of the remarks is determined.

In this way, when the recording medium does not need to be overturned, the recording medium is driven to enter the entry 50 of the recording medium overturning mechanism 200, pass through the first channel 10, and exit the exit 60 of the recording medium overturning mechanism 200 to reach the processor 400; and when the recording medium needs to be overturned, the recording medium is driven to firstly enter the overturning roller 70 through the second channel 20 from the entry 50 of the recording medium overturning mechanism 200 and afterwards the overturning roller 70 firstly rotates in a first direction to convey the recording medium away from the second channel 20, and then rotates in a direction opposite to the first direction to send the recording medium into the third channel 30, next, the recording medium enters the processor 400 via the exit 60 of the recording medium overturning mechanism 300 through the third channel 30.

After the recording medium exits the recording medium overturning mechanism 300, the front surface (the surface to be processed) of the recording medium opposes to the processor 400, whereby the processor 400 can conduct corresponding process to the recording medium, for example, the printing or the magnetic reading and writing etc.

The foregoing description is only preferred embodiments of the present invention, and shall not limit the present invention. Those skilled in the art should understand that the present invention can have various modifications and alternations. Any modification, equivalent replacements or improvements are all included in the protection scope of the present invention, without deviating from the spirit and principle of the present invention.

What is claimed is:

1. A recording medium overturning mechanism for conveying a recording medium with a front surface and a back surface, comprising:

a bracket (100);

an entry (50) and an exit (60), arranged in the bracket (100);

a first channel (10), communicating the entry (50) with the exit (60) to convey a recording medium which does not need to be overturned;

a second channel (20), communicating with the entry (50) to convey a recording medium which needs to be overturned;

a third channel (30), communicating with the exit (60) and the second channel (20) to convey the overturned recording medium, wherein the first channel (10), the second channel (20) and the third channel (30) are basically arranged in an inverted triangle and joined with each other;

a channel switching mechanism (40), arranged on the bracket (100) and located at a joining area between the first channel (10) and the second channel (20), for distributing the recording medium which does not need to be overturned into the first channel (10) or the recording medium which needs to be overturned into the second channel (20); and an overturning roller (70), arranged on the bracket (100) and located at a joining area between the second channel (20) and the third channel (30), the overturning roller (70), driven by a motor, firstly rotates in a first direction to convey the recording medium away from the second channel, and then rotates in a direction opposite to the first direction to send the recording medium into the third channel.

2. The recording medium overturning mechanism according to claim 1, wherein the channel switching mechanism (40) is hinged on the bracket (100), and the channel switching mechanism (40) comprises a first surface used to form the first channel (10) and a second surface used to form the second channel (20).

3. The recording medium overturning mechanism according to claim 2, wherein the channel switching mechanism (40) is a rotating plate, for switching the first channel (10) to communicate with the entry (50) while closing the second channel (20); or for switching the second channel (20) to communicate with the entry (50) while closing the first channel (10).

4. The recording medium overturning mechanism according to claim 1, further comprising:

an elastic apparatus (80), arranged on the bracket (100); and a first rotary plate C, located at a joining area between the second channel (20) and the third channel (30), wherein the first rotary plate C is hinged with the bracket (100) and rotationally connected with the elastic apparatus (80), for closing an exit end of the second channel (20) under the elastic force of the elastic apparatus (80).

5. The recording medium overturning mechanism according to claim 1, further comprising:

a second rotary plate (90), located at a joining area between the third channel (30) and the first channel (10), and hinged with the bracket (100), for closing an exit end of the third channel (30) under the gravity.

6. The recording medium overturning mechanism according to claim 1, further comprising:

an electromagnet, arranged on the bracket (100), wherein the electromagnet is connected with the channel switching mechanism (40) for controlling the channel switching mechanism (40).

7. The recording medium overturning mechanism according to claim 1, wherein a conveying roller for conveying the recording medium is provided at the entry (50) and the exit (60), respectively.

8. A recording medium processing apparatus, comprising the recording medium overturning mechanism according to claim 1, a ticket identifying apparatus for judging the direction of the front or back surface of the recording medium and a processor for processing the recording medium, wherein the ticket identifying apparatus is provided at the entry of the recording medium overturning mechanism, and the processor is provided at the exit of the recording medium overturning mechanism.

9. The recording medium processing apparatus according to claim 8, wherein the ticket identifying apparatus is a magnetic head identifying apparatus or an optical module identifying apparatus.

10. The recording medium processing apparatus according to claim 8, wherein the processor is a printing apparatus or a magnetic head apparatus.

* * * * *